US006237494B1

(12) United States Patent
Brunet et al.

(10) Patent No.: US 6,237,494 B1
(45) Date of Patent: May 29, 2001

(54) IGNITION COMPONENT FOR A PYROTECHNIC COMPOSITION OR PROPELLANT CHARGE

(75) Inventors: Luc Brunet; ANdré Espagnacq; Frantz Caillau; Patrick Guerenne, all of Bourges (FR)

(73) Assignee: Giat Industries, Versailles (FR)

( * ) Notice: Subject to any disclaimer, the term of this patent is extended or adjusted under 35 U.S.C. 154(b) by 0 days.

(21) Appl. No.: 09/152,483

(22) Filed: Sep. 14, 1998

(30) Foreign Application Priority Data

Sep. 24, 1997 (FR) ..... 97 11836

(51) Int. Cl.[7] ..... F42L 19/12

(52) U.S. Cl. ..... 102/202.7; 102/202; 102/202.8

(58) Field of Search ..... 102/202, 202.5, 102/202.7, 202.8, 202.9, 202.14, 472; 89/7, 8

(56) References Cited

U.S. PATENT DOCUMENTS

| | | | | |
|---|---|---|---|---|
| 2,899,864 | | 8/1959 | Bloxsom, Jr. . | |
| 4,054,940 | * | 10/1977 | Buchey et al. . | |
| 5,052,272 | | 10/1991 | Lee . | |
| 5,225,624 | * | 7/1993 | Schneider et al. | 89/8 |
| 5,231,242 | | 7/1993 | Chryssomallis et al. . | |
| 5,355,764 | * | 10/1994 | Marinos et al. . | |
| 5,359,919 | * | 11/1994 | Beyer . | |
| 5,431,105 | * | 7/1995 | Wilkinson . | |
| 5,444,208 | * | 8/1995 | Mortensen . | |
| 5,503,081 | * | 4/1996 | Lindblom et al. . | |
| 5,549,046 | * | 8/1996 | Widner et al. . | |

FOREIGN PATENT DOCUMENTS

| | | | | |
|---|---|---|---|---|
| 0348084 | * | 9/1960 | (CH) | 102/472 |
| 2364272 | * | 6/1975 | (DE) | 102/472 |
| 003716078 | * | 6/1990 | (DE) | 89/8 |
| 004003320 | * | 8/1991 | (DE) | 89/8 |
| 004142169 | * | 6/1993 | (DE) | 102/202 |
| 0 382 000 | | 8/1990 | (EP) . | |
| 000412897 A1 | * | 2/1991 | (EP) | 89/8 |
| 0 736 742 | | 10/1996 | (EP) . | |
| 2 670 279 | | 6/1992 | (FR) . | |
| 0006053 | * | 4/1896 | (GB) | 102/472 |
| 2123934 | * | 2/1984 | (GB) | 89/8 |
| 090005278 | * | 5/1990 | (WO) | 89/8 |

* cited by examiner

*Primary Examiner*—Michael J. Carone
(74) *Attorney, Agent, or Firm*—Oliff & Berridge, PLC

(57) ABSTRACT

The subject of the invention is an ignition component for a pyrotechnic composition or propellant charge.

This component comprises at least two electrodes separated by a cylindrical insulating envelope marking out an inner volume, electrodes connected by a conductive ignition fuse arranged in the inner volume, the component thus forming a plasma torch whose size is such that it generates a plasma when it receives an ignition voltage less than or equal to 600 volts and is supplied with electric energy less than or equal to 5000 joules.

10 Claims, 5 Drawing Sheets

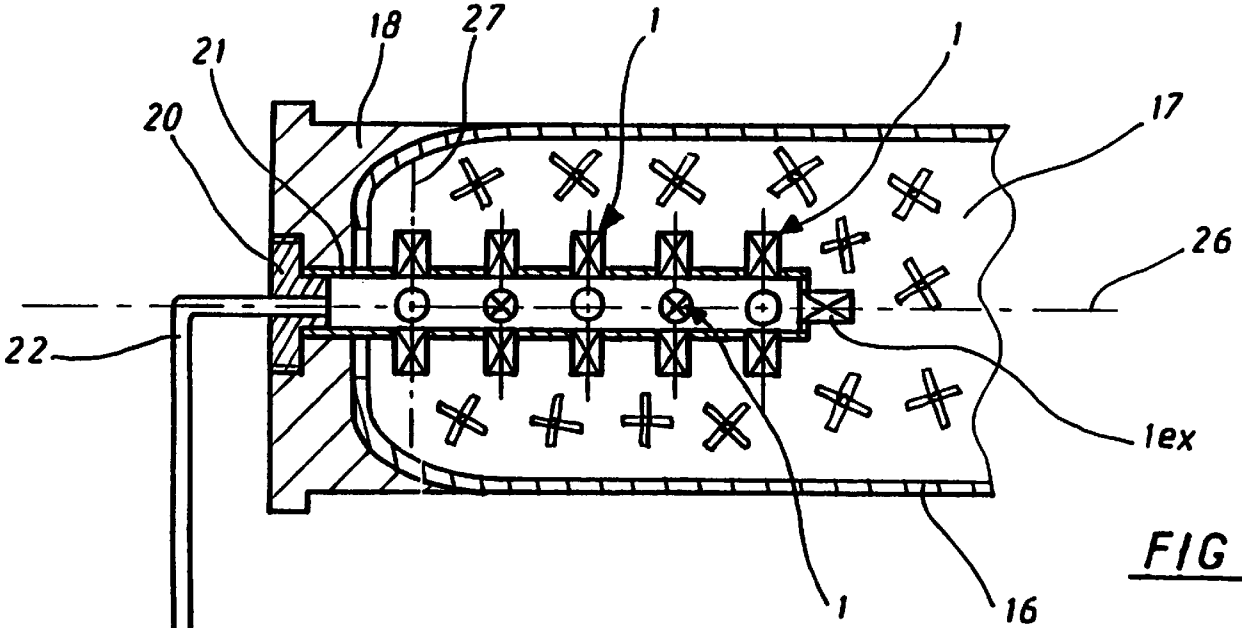
FIG 5a
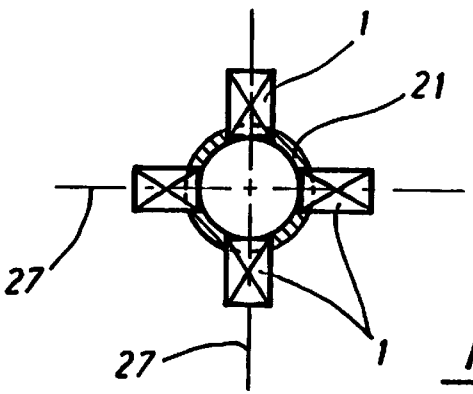
FIG 5b
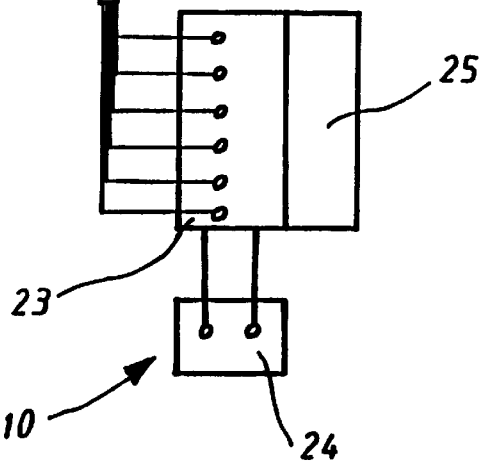

IGNITION COMPONENT FOR A PYROTECHNIC COMPOSITION OR PROPELLANT CHARGE

BACKGROUND OF THE INVENTION

The technical scope of the invention is that of components allowing the ignition of a pyrotechnic composition or else of the propellant charge of a piece of ammunition.

Known igniters comprise a pyrotechnic composition able to generate a flame whose temperature is high enough to ignite a propellant charge or else a working pyrotechnic composition (smoke, flare or gas-generating composition for example).

The ignition composition is itself initiated by an electric means which can be a hot wire, an exploding wire or else a semi-conductor bridge.

These components suffer from drawbacks.

Thus, they all implement a pyrotechnic ignition composition, which has a certain sensitivity, notably to overheating or to electrostatic discharges.

The handling and manufacture of these components therefore presents certain risks and the ammunition or devices implementing such components also run the risk of inadvertent ignition.

Furthermore, known components only operate once and they therefore deliver all their energy further to the passage of a current through the electric ignition means. Such a mode of operation is abrupt and can cause ignition heterogeneities in the composition that are likely to disturb the future combustion rate and cause pressure waves.

It is therefore impossible using known components to spread the distribution of energy over time in order to control the ignition rate of the pyrotechnic composition or of the propellant charge.

It is known elsewhere, in the field of artillery, to use a plasma torch to generate pressure allowing a projectile to be fired.

These plasma torches can be used alone (see for example patent U.S. Pat. No. 2,899,864) or can be combined with a conventional solid or liquid propellant charge (see for example patent U.S. Pat. No. 5,231,242) in a gun commonly named the "Electro-Thermal-Chemical Gun".

Known plasma torches are of considerable size (around 200 to 300 mm long) and consume a lot of energy (around one Megajoule) released in a manner that is difficult to control.

When they are used alone, they are designed so as to supply pressure allowing the projectile to be fired.

When they are combined with a propellant charge, the pressure moving the projectile results both from the combustion of the propellant charge and the plasma pressure generated by the torch, plasma that also modifies the combustion rate of the propellant charge.

In any event, the pressure supplied by the torch is substantial enough to allow an increase in the velocity of the projectile whilst keeping up the level of pressure applied to it.

Using such torches to ignite a pyrotechnic composition is totally out of the question, the energy developed and the pressure generated risk disorganising or destroying the pyrotechnic composition.

SUMMARY OF THE INVENTION

The aim of the invention is to propose an ignition component for a pyrotechnic composition or a propellant charge that does not suffer from the drawbacks of known ignition components.

Thus, the ignition component according to the invention ensures the reliable and reproducible ignition of pyrotechnic compositions and propellant charges.

It is inert, thereby substantially improving manufacturing safety and implementation and allowing ammunition to be developed that has greater resistance to environmental stresses (overheating, electrostatic discharges, shocks).

It is simply designed and is easy and inexpensive to manufacture.

A further aim of the invention is also to propose an ignition component allowing the ignition phenomenon of the composition or propellant charge to be controlled.

Used to ignite a propellant charge, the component proposed by the invention also allows extra energy to be supplied enabling greater velocities to be obtained for the projectile.

Yet another aim of the invention is to propose an ignition device which enables the ignition of a propellant charge to be controlled.

The subject of the invention is thus an ignition component for a pyrotechnic composition or a propellant charge, wherein it comprises at least two electrodes separated by a cylindrical insulating envelope marking out an inner volume, electrodes connected by a conductive ignition fuse arranged in the inner volume, the component thus forming a plasma torch whose size is such that it generates a plasma when it receives an ignition voltage less than or equal to 600 volts and is supplied with electric energy less than or equal to 5000 joules.

The ignition component according to the invention thus forms a plasma torch, but a torch of a very reduced size. In fact, in practical terms, such energy supply conditions cause a torch to be designed in which the distance separated the uninsulated parts of the electrodes through the free space (distance over which the electric arc is produced) is less than or equal to 10 mm (and is preferably around 5 mm).

The skill of the inventors lies in their considering that it was nevertheless possible to obtain a plasma using such a small structure, and in that the plasma obtained was enough to allow the ignition of a pyrotechnic composition or propellant charge.

In their development of the invention, they therefore deliberately set aside conventional wisdom in the field of pyrotechnic ignition components.

Thus, it could seem surprising that an ignition component intended to produce a flame could be designed that includes no flame-generating composition.

Neither could plasma torches lead them to a design for an ignition component. In fact, these torches are usually designed to deliver substantial energy levels required to set off a projectile. Such an area of use leads to the design of torches of a relatively substantial size in which the distance between electrodes is far enough for the strength of the electric arc discharge between electrodes to be high.

According to a variant embodiment, the ignition fuse can be formed of a fibrous conductive structure substantially filling all the inner volume marked out by the electrodes and the insulating envelope.

The fibrous structure will advantageously be formed by carbon filaments, or of one or several copper or magnesium wires. According to another characteristic of the invention, the component incorporates a cap blocking an exit boring for the gases generated and ensuring the confinement of the inner volume.

A further subject of the invention is an ignition device for a propellant charge using such an ignition component.

According to one variant, such an ignition device can incorporate at least three ignition components according to the invention integral with a support tube.

At least two ignition components can have their axes oriented in different directions.

According to another variant, the ignition device according to the invention can incorporate at least three ignition components evenly spaced on the external surface of the support tube and whose axes are substantially perpendicular to the axis of the support tube.

According to another embodiment of the invention, the ignition device can be such that the support tube also carries at least one pyrotechnic igniter.

The invention lastly concerns a propellant charge for a piece of ammunition incorporating a combustible envelope containing a propellant charge; charge characterised in that it incorporates an ignition device according to the invention.

Although low, the level of plasma energy generated by the component enables the pressure developed in the chamber of a small or medium calibre weapon to be increased and enables this pressure to be maintained for longer to the rear of the projectile.

It thus becomes possible using such a component to design small calibre (less than 14 mm) or medium calibre (less than 50 mm) Electro-Thermal-Chemical weapons and ammunition, which was impossible using known plasma torches whose range of use is limited to large calibres.

Moreover, the ignition component proposed by the invention, despite its small size, is able to deliver (using an appropriate electronic control device) several consecutive plasma jets separated by a few milliseconds.

By acting on the number and frequency of the pulses delivered by the component, the evolution of the pressure in the composition or propellant charge can be modulated and the chemical reaction or combustion can therefore be controlled.

For those weapons of a calibre greater than 25 mm it is possible to implement several ignition components according to the invention in order to make up an ignition device which will allow, by means of the combination of the plasmas generated by each component, to supply a global plasma of enough energy analogous to that supplied by known torches.

The ignition device according to the invention also allows the curve of the pressure build-up in the weapon chamber to be controlled, and thereby also the firing performances.

BRIEF DESCRIPTION OF THE DRAWINGS

Other advantages will become apparent from reading the following description of the different embodiments, description made with reference to the appended drawings in which:

FIG. 5*a* is a longitudinal section view of a propellant charge equipped with an ignition device according to a second embodiment of the invention, FIG. 5*b* is a cross section of the ignition device shown in FIG. 5*a,*

DETAILED DESCRIPTION OF PREFERRED EMBODIMENTS

Figure 1:
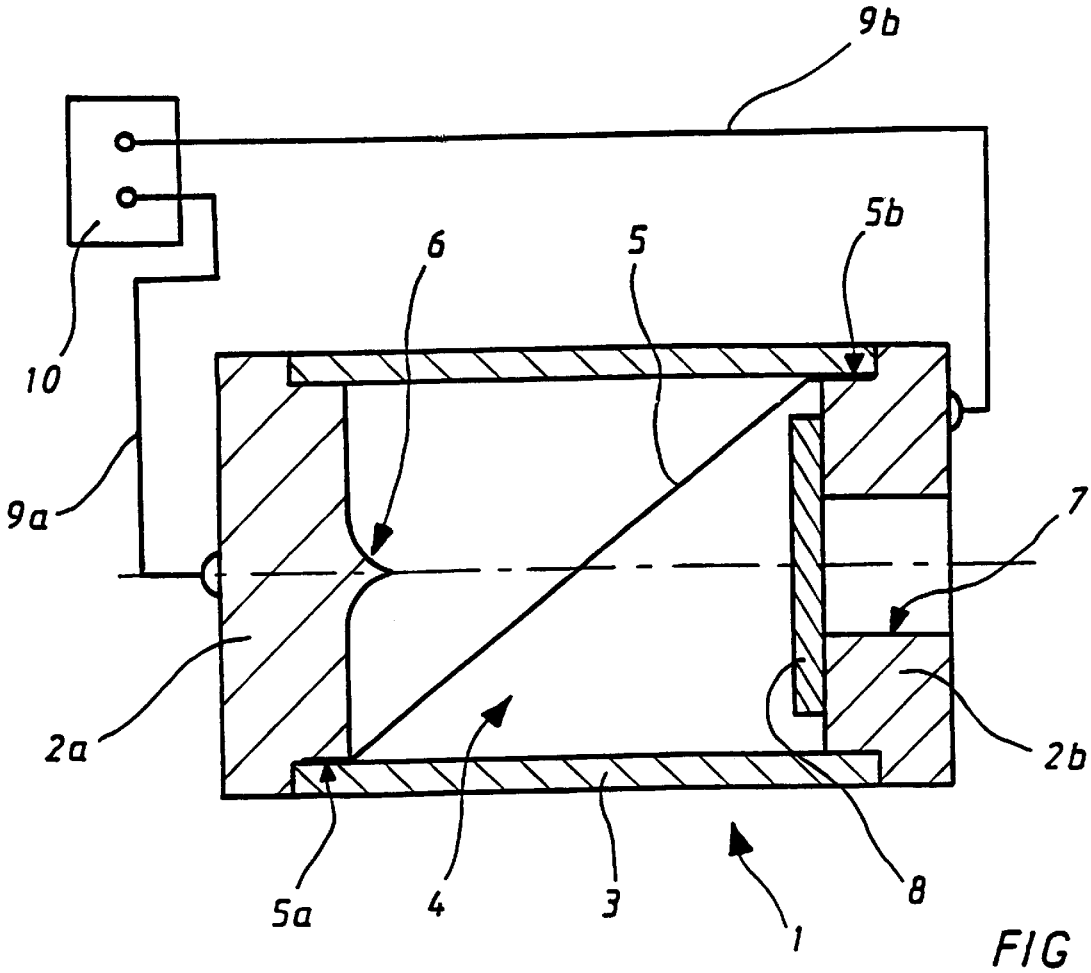
FIG. 1 is a longitudinal section view of an ignition component according to a first embodiment of the invention.

With reference to FIG. 1, an ignition component 1 according to the invention comprises at least two electrodes 2*a*, 2*b* separated by a cylindrical insulating envelope 3.

Electrodes 2*a* and 2*b* are made of metal (for example brass) and insulating envelope 3 can be made of a plastic material, for example polyethylene.

The electrodes and the envelope mark out an inner volume 4. The electrodes are connected by a conductive ignition fuse 5, which is arranged in inner volume 4.

The ignition fuse can for example by formed of a copper wire, and will advantageously be fastened to the envelope, for example by bonding.

Ends 5*a* and 5*b* of fuse 5 are pinched between the envelope and each of electrodes 2*a*, 2*b*.

Electrode 2*a* is full and carries a pointed axial stub 6 that is intended to form a base for the electric discharge arc. Electrode 2*b* incorporates an axial bore 7 through which the plasma generated by the component is intended to pass.

The bore is obturated by a polymer (for example Caption®) cap 8 which ensures both the gas-tightness of the component and the initial confinement of the plasma.

Cap 8 is bonded to electrode 2*b*, its diameter is slightly less than that of the electrode so as to leave an uninsulated part of electrode 2*b* opposite electrode 2*a*.

The electrodes are connected by wires 9*a*, 9*b* to a voltage generator 10.

The total external length of this component is around 20 mm; its external diameter is around 10 mm.

Inner volume 4 is thus around 1 cm3. The dimensions of this component are substantially those of known pyrotechnic igniters (squibs).

This ignition component is intended to be placed in the vicinity of or in contact with a pyrotechnic composition or propellant charge to be ignited.

It operates as follows.

Generator 10 supplies an ignition voltage to the component of around 500 to 600 volts. Ignition fuse 5 has a resistance selected such that the voltage supplied by the generator heats it vigourously causing it to vaporise. A copper or carbon wire with a diameter of less than 0.1 mm would suit perfectly.

The vaporisation of fuse 5 creates a low resistance (less than 500 milliohms) conductive medium inside cavity 4 whose effect is to initiate an electric arc between electrodes 2*a* and 2*b*. The excitation of the arc is aided by the presence of axial stub 6.

The electric arc causes an increase in the pressure and temperature inside cavity 4. This causes the material forming insulating envelope 3 to vaporise layer by layer (ablation).

Once a certain temperature and pressure level have been exceeded, cap 8 fractures releasing high-temperature high-pressure gases (plasma) out of the component and through axial bore 7.

By acting on the mechanical properties of the cap, it is possible to modify the pressure level required from the ignition component.

The temperature obtained using such a component is of 3,000 to 5,000° K. Such a temperature is enough to initiate almost any type of pyrotechnic composition or propellant charge.

One advantage of the ignition component according to the invention is that the inflammation plasma is obtained using a generator generating a current with an ignition voltage of a few hundred volts.

This results in a reduction in the problems of insulation and electromagnetic compatibility, therefore a simplification of the connexion, thereby allowing this component to be used in all types of weapon systems or pyrotechnic devices.

A further advantage of the component according to the invention lies in that it is totally inert, and thus can be manufactured and handled without any risk. Nor, moreover, can it be initiated inadvertently, as the plasma is only formed further to the vaporisation of the wire and in the presence of a difference in potential between the electrodes that has to be maintained for a lapse of time sufficient to form the arc (a few microseconds). These two conditions can not appear accidentally and simultaneously, for example further to an electrostatic discharge.

The ignition component according to the invention can be made in an extremely small size. It can be made in substantially the same size as a grain of propellant powder, that is around 6 mm long and 4 mm in diameter. The operating voltages will in this case be a little lower.

Figure 1A:
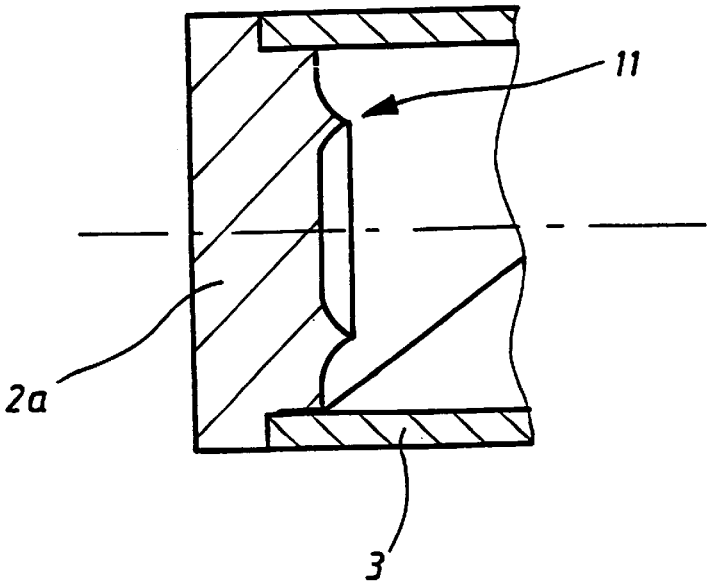
FIG. 1*a* is a partial view of a variant embodiment.

FIG. 1*a* shows a variant embodiment in which axial stub 6 is replaced by an arc-exciting ring 11. This variant enables the formation of electric arcs in the vicinity of insulating envelope 3 to be located, thereby aiding the ablation of the envelope and the rapid build-up of pressure.

Figure 2:
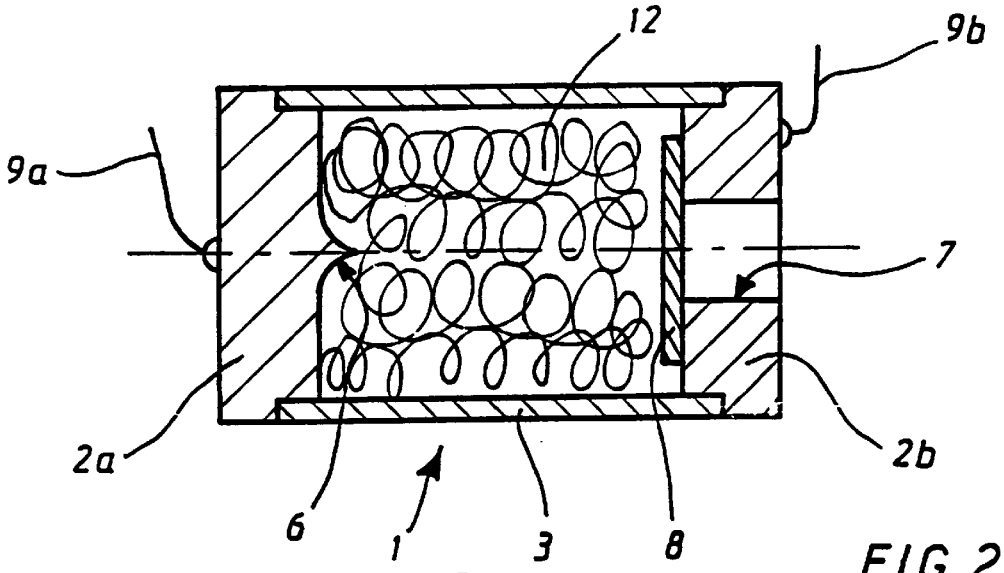
FIG. 2 is a longitudinal section view of a second embodiment of the invention.

FIG. 2 shows an ignition component according to a second embodiment of the invention.

This embodiment differs from the previous one in that ignition fuse 5 is replaced by a fibrous conductive structure 12 that substantially fills all the inner volume 4 marked out by electrodes 2*a*, 2*b* and insulating envelope 3.

Fibrous structure 12 can be composed of a ball made of a tangle of carbon filaments a few micrometers in diameter. This embodiment facilitates the manufacture and assembly to the ignition fuse. By way of a variant, it is also possible for copper or magnesium filaments around a tenth of a mm in diameter to be used.

Figure 3:
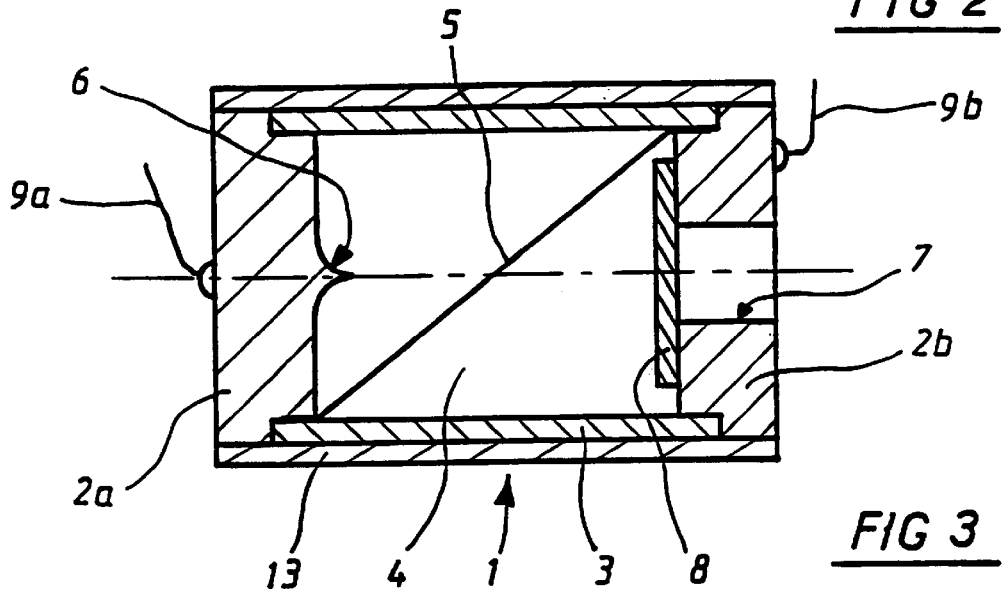
FIG. 3 is a longitudinal section view of an ignition component according to a third embodiment of the invention.

FIG. 3 shows an ignition component according to a third embodiment. This embodiment differs from the one in FIG. 1 in that insulating envelope 3 is enclosed in a mechanical reinforcement casing 13. This casing will be made of an insulating material, for example a filament coil made of glass fibres or Kevlar®.

By way of a variant, it is possible to use a reinforcement made of a conductive material (filament coil made of carbon fibres or else a metallic tube). But in this event electrical insulation will be provided between at least one electrode and the reinforcement.

Figure 3A:
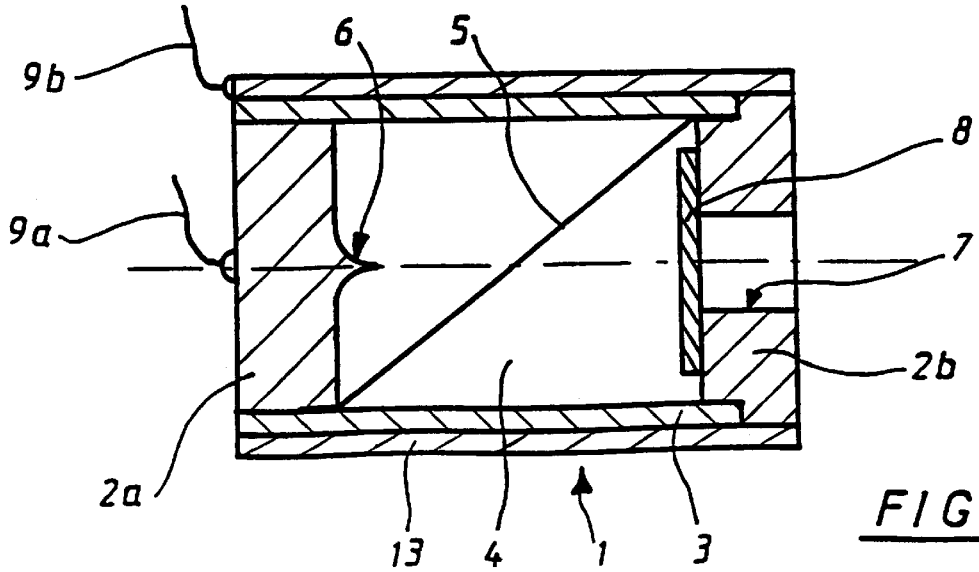
FIG. 3*a* is a view of a variant embodiment.

FIG. 3*a* shows such a variant embodiment. As reinforcement casing 13 is conductive, it is possible to fasten electric connection wires onto the same face of the component, on either side of insulating envelope 3.

Figure 4:
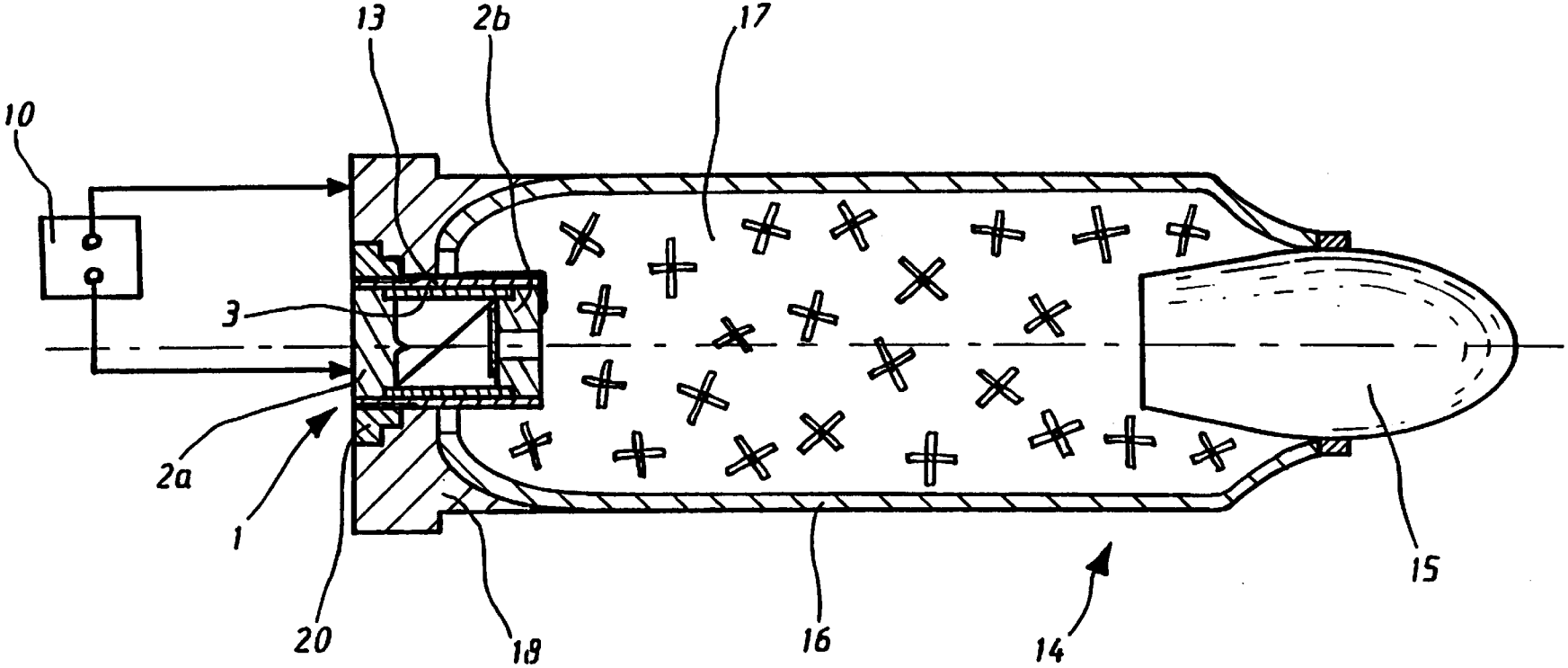
FIG. 4 is a longitudinal section view of a propellant charge equipped with an ignition device according to a first embodiment of the invention.

FIG. 4 shows a piece of ammunition 14 comprising a projectile 15 and a casing 16 for a propellant charge 17. At its rear part, the casing is fitted with a metallic base 18. The base incorporates an axial housing into which an ignition component 1 according to the invention is placed. The ignition component is fastened to the base by means of a connecting ring 20 integral with mechanical reinforcement 13.

The ignition component ensures the ignition of the propellant charge by applying voltage between electrodes 2*a* and 2*b*.

Furthermore, it is possible, by means of appropriate electronic control means incorporating, for example, high-voltage static relays, to apply the voltage in the form of successive strobes separated by breaks in the current.

In the case, the ignition component supplies several consecutive jets of plasma separated by lapses of time whose duration can be programmed (from a few microseconds to a few milliseconds).

It is possible, in this case, to supply the ignition energy to the propellant charge gradually over time.

The curve of the pressure build-up in the gun chamber is thereby improved, improvement reflected in the internal ballistics of the projectile and the firing performances.

The pressure supplied by the plasma is added, moreover, to that supplied by the propellant powder and it also modifies the combustion rate of the latter, thereby increasing the velocity of the projectile.

It is therefore possible, using the ignition component according to the invention, to design electro-thermal-chemical weapon systems with almost no modifications to the weapon (since the plasmas generator is integral with the ammunition casing) and for all calibres, notably those calibres less than 50 mm.

FIGS. 5*a* and 5*b* show an ignition device that is more particularly suited to the ignition of large calibre (greater than 50 mm) propellant charges. This ignition device incorporates a support tube 21, made of metal or a plastic material, and that extends along axis 26 of the ammunition in a similar way to a conventional artillery primer tube. This tube is made integral with base 18 of the munition by means of a fastening ring 20 and it carries several ignition components 1 according to the invention evenly spaced around its periphery.

The different ignition components are shown schematically in this example. Axis 27 of each component is substantially perpendicular to axis 26 of support tube 21 with the exception of one component lex , which is placed at the end of the tube and whose axis matches that of the tube.

The ignition components are oriented such that the plasma they generate is diffused in the propellant charge 17 enclosing tube 21. They are, therefore, fastened to tube 21 by their non-perforated electrode 2*a*.

Tube 21 receives the different electrical supply wires of the components. A single wire per component can be provided (connected to electrode 2*a*) and the reverse current to all the components 1 can be provided via support tube 21.

The supply wires are gathered together in a strand 22 that is connected to electric generator 10.

The generator comprises a high-voltage source 24 as well as a switch contactor 23 that enables the high-voltage source to be connected to one or several ignition components.

The switch contactor will comprise, for example, different high-voltage static relays. Contactor 23 is controlled by a programmer 25 (such as a microprocessor) into which the ignition sequence of the different components are introduced before firing.

This ignition device enables the pressure build-up in the weapon chamber to be accurately controlled, thereby also controlling the firing performances.

In fact, it is possible, in this example, to initiate each of ignition components 1 individually and also to give it an individual ignition/burn out sequence.

The ignition components can, for example, be controlled successively starting with those closest to base 18.

All the components can firstly be controlled simultaneously so as to ensure the almost instantaneous ignition of the whole of propellant charge 17 then, after disconnection of at least part of the components, only part of the components can be controlled so as to avoid creating peaks of pressure and to spread the pressure more evenly as the projectile moves forward.

It must be noted that the combination of several components according to the invention can supply plasma enabling the velocity of the projectile to be further increased.

Thanks to the invention, it is possible to obtain a maximal energy level of a similar magnitude as that obtained using known plasma torches but with the ability to control the evolution of the pressure in the weapon chamber both easily and accurately.

Figure 6:
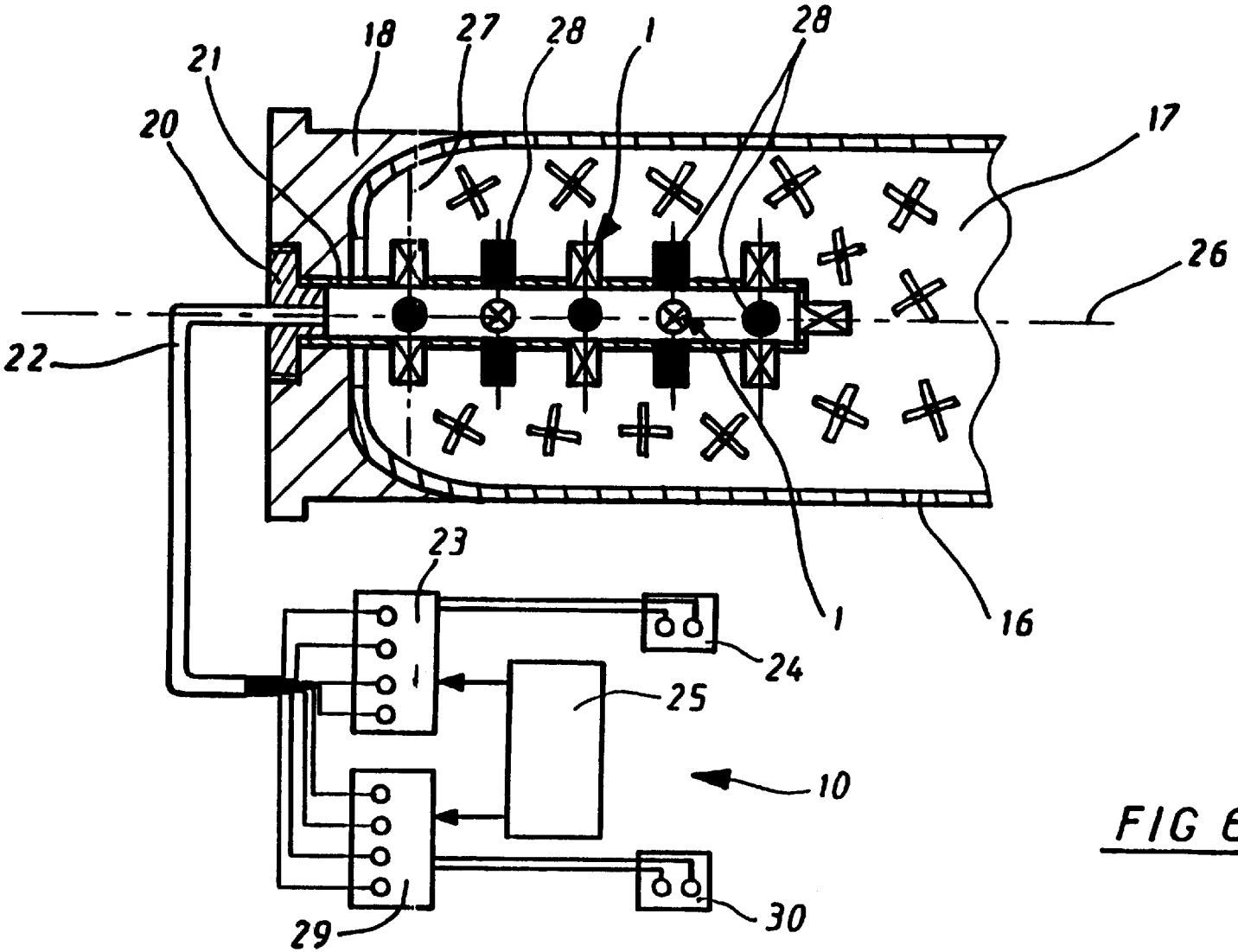
FIG. 6 is a longitudinal section view of a propellant charge equipped with an ignition device according to a third embodiment of the invention.

FIG. 6 shows another embodiment, which differs from the previous one in that the support tube carries both the ignition components 1 according to the invention and conventional pyrotechnic squibs 28.

Electric generator 10 in this example incorporates a high-voltage source 24 and a switch contactor 23, which enables the high-voltage source to be, connected to one or several ignition components 1.

It also incorporates a second switch contactor 29 which enables a low-voltage source 30 to be connected to one or several pyrotechnic components 28.

Contactors 23 and 29 are controlled by programmer 25 into which the ignition sequence for the different components is introduced before firing.

This variant allows the pressure evolution in the weapon chamber to be acted upon differently.

Ignition components 1 can be used to heat and vaporise part of propellant charge 17, the pyrotechnic components are then initiated, their action is amplified by the fact that the propellant charge has started to react. It is thus possible using this system to deliver as much energy as the previous embodiment but with less powerful plasma components.

It is naturally possible by way of a variant to orient differently the axes of the various ignition components or else to use a different number of components. It is also possible to give the torches in FIGS. 1 to 3 different shapes and notably different arc base shapes (spherical, cylindrical, . . . ).

The ignition component according to the invention can lastly be used for application other than ignition, for example, for metal cutting or welding.

What is claimed is:

1. An ignition component for a pyrotechnic composition or a propellant charge, comprising:

at least two electrodes;

a cylindrical insulating envelope separating the at least two electrodes and defining an inner volume; and a conductive ignition fuse arranged in the inner volume and connecting the at least two electrodes, wherein a plasma torch is formed when the electrodes receive an ignition voltage less than or equal to 600 volts and an electric energy less than or equal to 5000 joules.

2. An ignition component according to claim 1, wherein said ignition fuse is formed of a fibrous conductive structure substantially filling all the inner volume marked out by the electrodes and the insulating envelope.

3. An ignition component according to claim 2, wherein said fibrous structure is formed of carbon filaments, or of one or several copper or magnesium wires.

4. An ignition component according to one of claim 1, wherein it incorporates a cap blocking an exit boring for the gases generated and ensuring the confinement of said inner volume.

5. A piece of ammunition, comprising:

a projectile;

a casing;

a propellant charge; and at least one ignition component comprising:

at least two electrodes;

a cylindrical insulating envelope separating the at least two electrodes and defining an inner volume; and a conductive ignition fuse arranged in the inner volume and connecting the at least two electrodes, wherein a plasma torch is formed when the electrodes receive an ignition voltage less than or equal to 600 volts and an electric energy less than or equal to 5000 joules.

6. A piece of ammunition according to claim 5, wherein it incorporates at least three ignition components integral with a support tube.

7. A piece of ammunition according to claim 6, wherein at least two ignition components have their axes oriented in different directions.

8. A piece of ammunition according to claim 7, wherein it incorporates at least three ignition components evenly spaced on the external surface of said support tube and whose axes are substantially perpendicular to the axis of the support tube.

9. A piece of ammunition according to one of claim 8, wherein said support tube also carries at least one pyrotechnic igniter.

10. A propellant charge for a piece of ammunition, comprising:

a combustible envelope containing a propellant charge; and at least one ignition component comprising:

at least two electrodes;

a cylindrical insulating envelope separating the at least two electrodes and defining an inner volume; and a conductive ignition fuse arranged in the inner volume and connecting the at least two electrodes, wherein a plasma torch is formed when the electrodes receive an ignition voltage less than or equal to 600 volts and an electric energy less than or equal to 5000 joules.

* * * * *